United States Patent [19]

Rudoy

[11] Patent Number: 4,932,893

[45] Date of Patent: Jun. 12, 1990

[54] DOUBLE BEAM SOCKET CONTACT

[75] Inventor: Edward Rudoy, Woodland Hills, Calif.

[73] Assignee: ITT Corporation, New York, N.Y.

[21] Appl. No.: 398,572

[22] Filed: Aug. 25, 1989

[51] Int. Cl.[5] ..... H01R 4/24

[52] U.S. Cl. ..... 439/395

[58] Field of Search ..... 439/389–426

[56] References Cited

U.S. PATENT DOCUMENTS

| | | | |
|---|---|---|---|
| 3,369,210 | 2/1968 | Menickella | 339/9 |
| 4,018,177 | 4/1977 | McKee et al. | 113/119 |
| 4,027,521 | 6/1977 | McKee et al. | 72/404 |
| 4,241,970 | 12/1980 | Rider, Jr. et al. | 339/99 |
| 4,288,141 | 9/1981 | Lether | 339/97 |
| 4,466,687 | 8/1984 | Frantz | 339/198 |
| 4,560,226 | 12/1985 | Dennis | 439/395 |
| 4,586,775 | 5/1986 | Nestor et al. | 339/97 |
| 4,684,197 | 8/1987 | Reichardt et al. | 439/404 |

FOREIGN PATENT DOCUMENTS

| | | |
|---|---|---|
| 863228 | 1/1953 | Fed. Rep. of Germany . |
| 2146495 | 4/1985 | United Kingdom . |

*Primary Examiner*—Joseph H. McGlynn

*Attorney, Agent, or Firm*—Thomas L. Peterson

[57] ABSTRACT

A formed sheet metal contact is described of the type that has first and second terminations at its opposite ends, with the second termination being a socket termination for engaging a pin, which saves on material and tooling in manufacture and which enables the termination ends to lie closer together. The contact is formed of an elongated strip with its first and second ends forming first and second terminations (14, 16 in FIG. 2), with first and second middle parts and a bend (40) of about 45° between them, and with the second end of the strip bent about 360° about a pin-receiving axis (44) to form a socket.

12 Claims, 3 Drawing Sheets

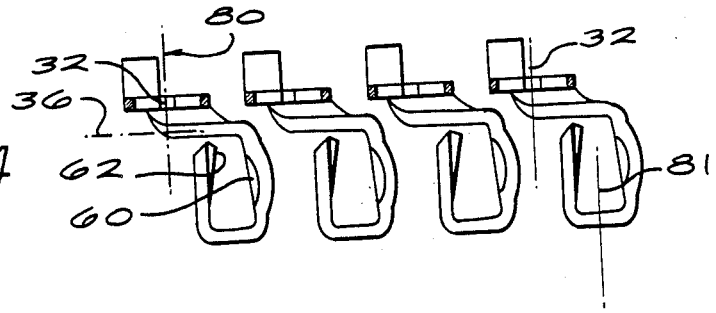
FIG. 4
FIG. 3
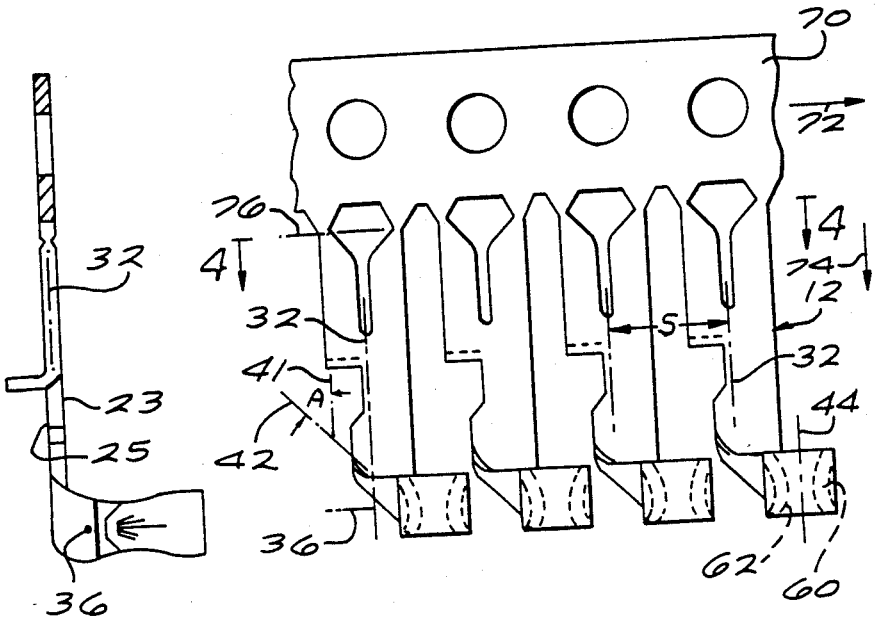
FIG. 6
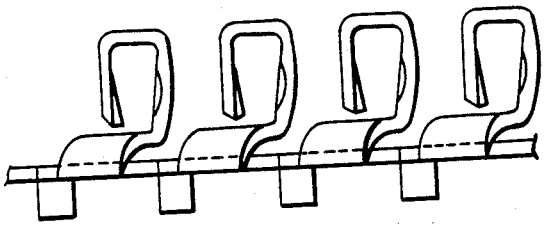
FIG. 5

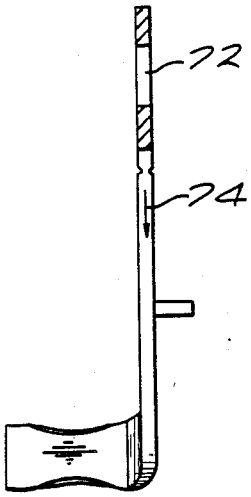
FIG. 7
FIG. 8
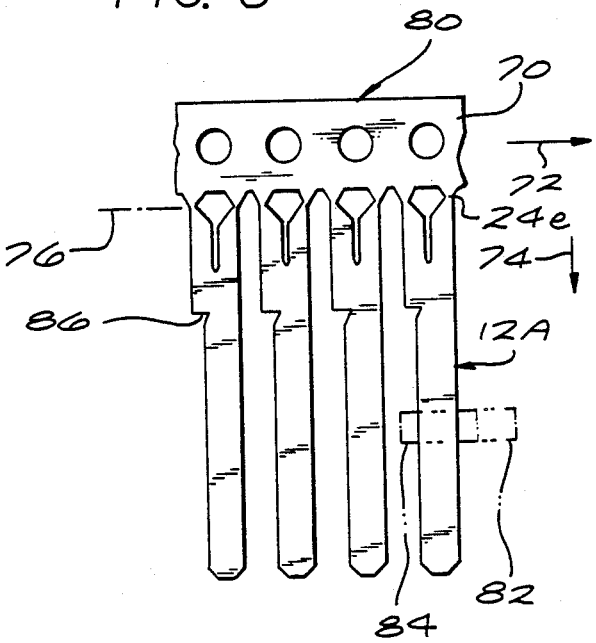
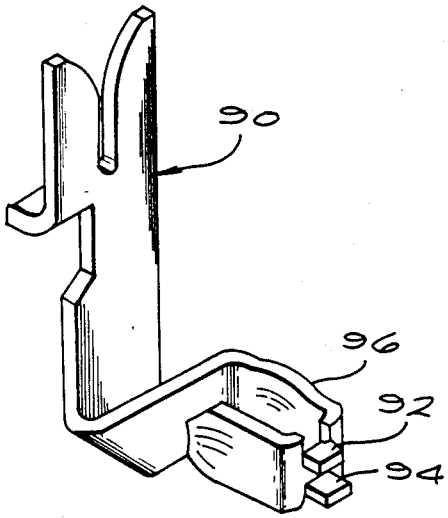
FIG. 9
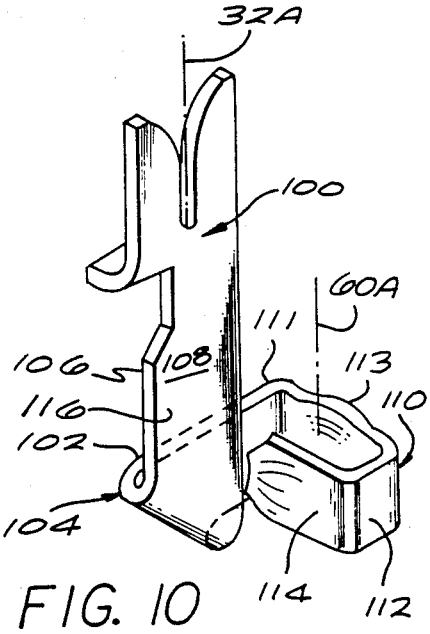
FIG. 10

DOUBLE BEAM SOCKET CONTACT

BACKGROUND OF THE INVENTION

A wide variety of connectors use contacts with terminations at its opposite ends, and with one of the terminations being a socket termination for receiving a pin contact or the like. The contacts are commonly formed from sheet metal with portions cut away to leave a carrier extending in a first direction and with numerous strips extending in a perpendicular second direction, with the strips being bent to the desired contact configuration. In order to form an end of the strip as a socket, the ends of the strips are often formed with long sideward protrusions that can be bent around to form the desired socket configuration. The wide sideward protrusions result in the need to have the contact strips widely spaced along the carrier, so that a lot of material is wasted and fewer strips can be stamped with tooling of a given size. Also, the socket designs often result in the socket lying a considerable distance from the first termination end, which makes it difficult to form a compact connector. A contact formed of sheet metal with a socket termination at one end, which could be constructed with minimal waste of sheet metal to minimize cost, and which enabled the contact to be used in a compact connector, would be of considerable value.

SUMMARY OF THE INVENTION

In accordance with one embodiment of the present invention, an electrical contact is provided, of the type that is formed from sheet metal to have a socket termination at one end, which can be constructed at low cost and which enables construction of a compact connector. The contact includes an elongated strip with first and second middle parts and a bend of about 45° between them. The second end of the contact which extends from the second part of the middle, extends about 360° around a pin-receiving axis to form a socket. A large number of such contact, all held on a carrier strip, can be formed from a sheet of metal with the carrier strip extending in one direction and numerous strips extending in a second direction from the carrier strip. The strips that are to form the contacts have no sideward protrusions, or only short ones, so that the strips can be placed close together along the length of the carrier strip to save material.

The novel features of the invention are set forth with particularity in the appended claims. The invention will be best understood from the following description when read in conjunction with the accompanying drawings.

BRIEF DESCRIPTION OF THE DRAWINGS

FIG. 3 is a front elevation view of a group of contacts of the type shown in FIG. 2, shown held on a carrier.

FIG. 4 is a top view of the group of FIG. 3, taken on the line 4—4 of FIG. 3.

FIG. 5 is a bottom view of the group of FIG. 3.

FIG. 6 is a left side view of the group of FIG. 3.

FIG. 7 is a right side view of the group of FIG. 3.

FIG. 8 is a front elevation view of the group of contacts and a carrier of FIG. 3, during its construction, after removal of metal from a sheet of metal, but before bending of the metal.

FIG. 9 is an isometric view of a contact constructed in accordance with another embodiment of the invention.

FIG. 10 is an isometric view of a contact constructed in accordance with still another embodiment of the invention.

DESCRIPTION OF THE PREFERRED EMBODIMENTS

Figure 1:
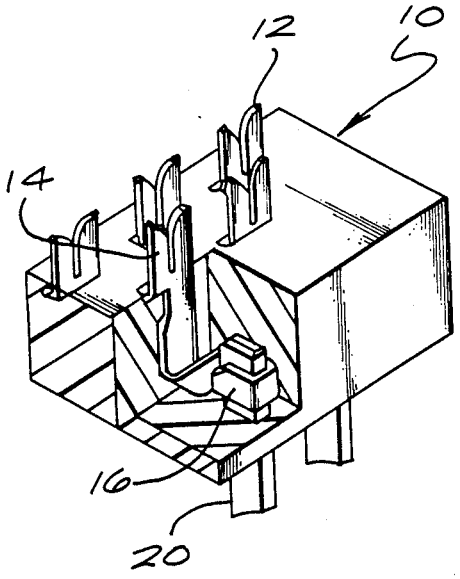
FIG. 1 is a partial, sectional and isometric view of a connector constructed in accordance with one embodiment of the present invention.

FIG. 1 illustrates a connector 10 which has a plurality of contacts 12 arranged in two rows in an insulative housing 13. Each contact has first and second terminations 14, 16 at its opposite ends. The first termination 14 is shown as an insulation displacement type, which engages a wire lying on axis 18. The second termination 16 is a socket termination which receives a blade pin 20, that may be rectangular (square or non-square) or round. The locations where the second termination engages the pin is at the level of axis 19.

Figure 2:
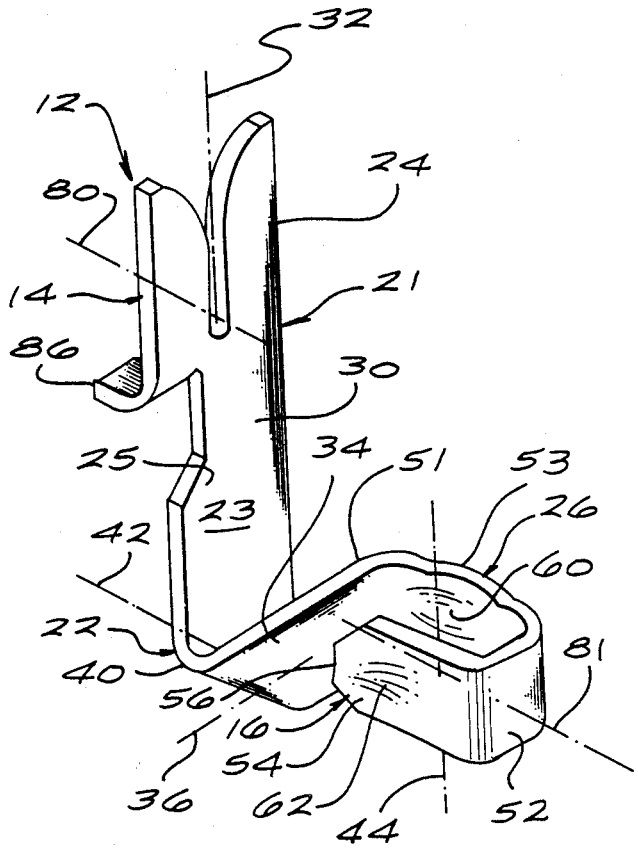
FIG. 2 is an isometric view of a contact of the connector of FIG. 1.

As shown in FIG. 2, the contact includes a bent strip 21 of metal with front and rear faces 23, 25. The contact includes a middle 22 lying between first and second terminal end portions 24, 26 that form the terminations. The middle 22 includes a first part 30 extending along a first axis 32, a second part 34 extending along a direction 36 that is substantially perpendicular to the first axis 32, and a bent part or bend 40 between the first and second parts of the middle. The bend 40 extends approximately 180°. about a bend axis 42 that extends approximately 45° to both the first axis 32 and the direction 36. (FIG. 3 shows that the bend axis extends at an angle A of about 45° to a line 41 that is parallel to axes 32 and 44.) The second terminal end portion 26 is bent approximately 360° (more than two thirds of a turn or 240°) about a second axis 44 that extends substantially parallel to the first axis 32. The particular termination is designed to receive a pin of rectangular (square or non-square) or round cross section. The second termination or socket end portion is bent to include four sides including a first side 51, second side 52, third side 53, and fourth side 54. The first side 51 merges with the second part 34 of the contact middle. It can be seen that the extreme second end of the contact forms one end 56 of the fourth side 54 which is free, which facilitates bending of the fourth side 54. The third and fourth sides have inwardly-projecting (toward axis 44) dimples 60, 62 lying at the level of axis 19. The dimples provide narrow regions of contact with the pin (20 in FIG. 1) to provide good contact therewith. Good contact is enhanced by the fact that the dimpled fourth side 54 can be easily deflected away from the other side as a pin is received in the second termination. The dimpling at opposite sides provides two points of contact for more reliable contact.

As shown in FIG. 3, multiple contacts 12 are all formed from a single sheet of metal, the metal being formed with a carrier 70 extending in a first direction 72, and with the multiple contacts 12 extending in a perpendicular direction 74. The contacts are joined to the carrier at a separation line 76, and are severed from the carrier at the separation line during installation. The carrier holds the contacts at predetermined positions and spacings, to facilitate handling prior to installation in a connector. It is desirable to have contact spacings S as close together as possible, to minimize the amount of metal used, enable more contacts to be stamped out of the sheet in each stamping operation for tooling of given size, and to facilitate storage and handling, all of which reduce cost.

FIG. 8 illustrates a sheet of metal 80 in which all the contacts at 12A have been stamped, but none have been formed. That is, all portions of the sheet 80 are coplanar. Instead of using applicant's approach, each contact such as 12A might instead be formed with extensions indicated at 82 and 84, that could be bent to encircle a pin-receiving axis by about 180°, to contact a blade pin of the dimensions shown at 20 in FIG. 1. The considerable width of the extensions would necessitate wide spacing of contacts from each other along the first direction 72 of the length of the carrier. This would result in wastage of considerably more metal, as well allowing fewer contacts to be stamped for a given size tooling and requiring more storage and handling space. Instead, applicant forms the stamped but unbent contacts at 12A so they are substantially devoid of sideward projections along the first direction 72. That is, the width all along the contact is not much more than the width of the extreme first end 24e of each contact at the separation line (less than 25% greater). After stamping the sheet, a locator 86 at the first end is bent, the middle is bent at a 45° angle, and the second end is bent to substantially encircle a pin. A variety of pin shapes can be encircled, including cylindrically shaped pins. In addition to saving metal, this invention results in the axes 18, 19 (FIG. 1) at the opposite ends lying close together, which enables the construction of a contact of low thickness T.

FIG. 9 illustrates a contact 90 similar to that of FIG. 2, but with retaining tabs 92, 94 formed in one of the four sides of the second termination 96. The tabs project into insulation of the connector housing to help prevent movement of the second termination end as a pin is inserted or withdrawn from the second termination end.

FIG. 10 illustrates a contact 100 in which the second part 102 of the middle 104 is bent to extend adjacent to a rear face 106 of the contact strip (which is opposite the front face 108). The second termination end 110 has four sides 111–114 similar to the contact of FIG. 2. However, with the bend extending to the rear face of the contact, the axes 32A, 60A of a second part 116 of the middle and of the second termination are slightly closer together, and the termination axis 60A lies closer to the plane of the strip-shaped second part 116 of the middle of the contact.

Thus, the invention provides an electrical contact and method for making it, which minimizes the use of sheet metal and facilitates production of the contacts and their use in a compact connector. The contact is formed substantially as a straight strip and has a bend at its middle, with the axis of the bend extending about 45° to parts of the contact on either side of the bend. The second end portion of the contact is a portion of the strip bent approximately 360° around an axis along which a pin contact is received. A dimple is formed near the extreme second end of the contact and on the opposite side of the socket, to provide concentrated pressure against the pin at locations that can deflect together and apart. The approximately 45° bend at the middle can extend to either side of the first end portion of the contact.

Although particular embodiments of the invention have been described and illustrated herein, it is recognized that modifications and variations may readily occur to those skilled in the art and consequently it is intended to cover such modifications and equivalents.

What is claimed is:

1. In an electrical contact formed of a sheet of metal with an elongated strip having first and second termination ends and a middle between them, and with the second termination end forming a socket with a first side extending from said middle, said socket extending approximately 360° around a pin-receiving axis, the improvement wherein:

said middle of said contact has a first part extending parallel to said pin-receiving axis, a second part merging with said first side of said socket, and a bend between said first and second parts, said bend having a bend axis extending at substantially 45° to an imaginary line parallel to said pin-receiving axis.

2. The improvement described in claim 1 wherein:

said second termination end has first and second opposite sides and has third and fourth opposite sides, and said contact has an extreme second end at said fourth side;

said third and fourth sides each have top and bottom edges and a middle between them which is dimpled toward the opposite side.

3. The improvement described in claim 1 wherein:

said first part of said middle has front and rear faces, said front face lying closer to said pin-receiving axis than said rear face;

said second part of said middle extends over said front face.

4. The improvement described in claim 1 wherein:

said first part of said middle has front and rear faces, said front face lying closer to said pin-receiving axis than said rear face;

said second part of said middle extends over said rear face.

5. The improvement described in claim 1 wherein:

said sheet metal includes a carrier extending along a first direction, and a plurality of additional contacts and said first mentioned contact all having first ends extending in a second direction that is perpendicular to said first direction, and said middle and second end of each contact are bent portions of said strip which are of substantially constant width.

6. A method for manufacturing a plurality of contacts from a sheet of metal by removing portions of a continuous metal sheet to leave a carrier extending in a first direction and a plurality of elongated strips extending substantially perpendicular to said first direction, the improvement comprising:

forming each of said strips with a first termination portion nearest said carrier, and with a second elongated portion having a middle and a second end and extending substantially along said second direction;

bending a location along said middle so a second part that lies on a second side of said bend furthest from said first termination portion extends primarily perpendicular to said second direction and parallel to said first direction;

bending said second end about an axis extending primarily along said second direction, to extend about 360° around said axis to form a socket type second termination portion, whereby to form a plurality of contacts that each have a pair of opposite termination portions, and that are closely spaced along the carrier.

7. The method described in claim 6 wherein:

said step of bending a location along said second portion includes forming a substantially 180° bend with an axis that extends approximately 45° to said first direction and to said second direction.

8. The method described in claim 6 wherein:

said middle has a first part that lies on a side of said bend opposite said second part, said first part lying substantially in a plane and having a front face closest to said axis and an opposite rear face;

said step of bending includes bending said location so that said second part extends along said front face of said first side.

9. The method described in claim 6 wherein:

said middle has a first part that lies on a side of said bend opposite said second part, said first part lying substantially in a plane and having a front face closest to said axis and an opposite rear face;

said step of bending includes bending said location so said second part extends along said rear face of said first side.

10. The method described in claim 6 wherein:

said socket type second termination portion has third and fourth opposite sides, with the extreme end of said strip furthest from said carrier lying adjacent to said fourth side; and including deforming locations along said strip which form said third and fourth sides, to form dimples therein to engage a pin projected through said socket type second termination portion.

11. A connector comprising:

a housing of insulative material; and a plurality of contacts mounted in said housing, each contact having first and second termination ends, with said second termination end forming a socket to receive a pin contact extending along a second axis;

each of said contacts including a strip of metal having front and rear faces, and each of said contacts having a bend location between said termination ends;

said metal strip having first and second parts on opposite sides of said bend, said first part extending along a predetermined direction substantially parallel to said second axis and said second part extending along a direction that is substantially perpendicular to said predetermined direction.

12. The connector described in claim 11 wherein:

said second termination end extends approximately 360° around said second axis, and has a free end, said strip having a first dimple adjacent to said free end and having a second dimple at a location opposite said first dimple.

* * * * *